US011391528B2

(12) United States Patent
Radojicic et al.

(10) Patent No.: US 11,391,528 B2
(45) Date of Patent: Jul. 19, 2022

(54) COCKING AND PERCUSSION MECHANISM FOR SINGLE-TRIGGER DUAL LAUNCHERS AND WEAPONS EQUIPPED THEREWITH

(71) Applicants: Securengy SAS, Verrières le Buisson (FR); Cyrille Raquin, Verrières le Buisson (FR)

(72) Inventors: Dejan Radojicic, Trstenik (RS); Cyrille Raquin, Verrières le Buisson (FR)

(73) Assignees: Securengy SAS, Verrieres le Buisson (FR); Cyrille Raquin, Verrieres le Buisson (FR)

( * ) Notice: Subject to any disclaimer, the term of this patent is extended or adjusted under 35 U.S.C. 154(b) by 0 days.

(21) Appl. No.: 17/152,180

(22) Filed: Jan. 19, 2021

(65) Prior Publication Data

US 2021/0222982 A1 Jul. 22, 2021

(51) Int. Cl.
*F41A 19/21* (2006.01)

(52) U.S. Cl.
CPC ..... *F41A 19/21* (2013.01)

(58) Field of Classification Search
CPC ..... F41A 19/21; F41A 19/19; F41A 19/18; F41A 19/24; F41A 19/52; F41A 19/53; F41A 19/54
USPC ..... 89/1.41; 42/40, 41, 42.01
See application file for complete search history.

(56) References Cited

U.S. PATENT DOCUMENTS 524,140 A * 8/1894 Granger ..... F41A 19/21 42/42.01
690,243 A * 12/1901 Long ..... F41A 19/21 42/42.01
699,291 A * 5/1902 Long ..... F41A 19/21 42/42.01
975,071 A * 11/1910 Ricketts ..... F41A 19/21 42/43
1,462,169 A * 7/1923 Lewis ..... F41A 9/65 89/33.16
2,643,476 A * 6/1953 Kilgore ..... F41C 3/08 42/57

(Continued)

FOREIGN PATENT DOCUMENTS

FR 2585818 A1 2/1987
FR 2775268 A1 8/1999

(Continued)

*Primary Examiner* — John Cooper
(74) *Attorney, Agent, or Firm* — Muncy, Geissler, Olds & Lowe, P.C.

(57) ABSTRACT

A mechanical device for cocking and percussion for single-trigger individual weapon and two barrels, which are plain or striped, juxtaposed or superimposed and weapons using such device are provided. The device is intended for defense weapons that use two center-fire or annular firing barrels or tubes using mechanical energy to initiate a pyrotechnic primer. It uses the action of the trigger on a single ratchet, attached to a gearwheel and an action piece on the hammer; this action is made alternative by a duplication of this gear wheel and action piece, one being driven by the other in rotation so that the actions on one or the other barrels are alternative. The weapon equipped with such a device can be equipped with an associated additional device that allows the visualization of the active barrel as well as the change of barrel that will fire the next shot.

8 Claims, 4 Drawing Sheets

(56) References Cited

U.S. PATENT DOCUMENTS

| | | | | |
|---|---|---|---|---|
| 2,902,788 | A * | 9/1959 | Laager | F41A 19/40<br>89/147 |
| 2015/0253097 | A1* | 9/2015 | Kohout | F41A 19/21<br>42/8 |
| 2016/0282074 | A1* | 9/2016 | Kohout | F41A 19/21 |
| 2018/0224229 | A1* | 8/2018 | Teach, Jr. | F41A 21/02 |

FOREIGN PATENT DOCUMENTS

| | | | | |
|---|---|---|---|---|
| FR | 2801377 | A1 * | 5/2001 | F41A 19/22 |
| WO | WO-0138816 | A1 * | 5/2001 | F41A 19/22 |

* cited by examiner

COCKING AND PERCUSSION MECHANISM FOR SINGLE-TRIGGER DUAL LAUNCHERS AND WEAPONS EQUIPPED THEREWITH

FIELD OF THE INVENTION

The present invention relates to the field of armament and more particularly to small, medium or large-caliber single-trigger launchers or weapons with dual barrels, whether are superimposed or juxtaposed.

BACKGROUND

The state of the art can be illustrated by the content of the patent FR 2.585.818, which concerns a two-gun weapon and possibly two calibers equipped with tilting barrels equipped with a mechanism for an external armament and with a trigger for each barrel. The patent FR 2.801.377 describes a mechanism and a weapon for medium or big calibers equipped with a single trigger and operating in double action, cocking and percussion resulting from a single action on the trigger, for the two barrels alternatively by the use of a ratchet rotating around an axis perpendicular to the two firing pins.

This realization leads to production and quality control difficulties due to the precision of the parts required, moreover the firing pins have a displacement that is typically shifted in relation to the axis of the barrels of more than 20°. This configuration has shown during the use of such weapons for many years, that it generates many problems of percussion because of the point of impact of the firing pin in a wider area because of this design. Such malfunctions persist even if wider primers, such as the hunting type, are used.

In addition, such a realization requires a greater overtaking of the firing pin relative to the breech or bulwark of the weapon, which can be a source of primer perforations with some cartridges.

The patent FR 2 775 268 describes a dual barrel weapon in which each of them is respectively triggered by an associated trigger, the choice of the trigger is controlled by a selection piece that moves in translation perpendicular to the barrels, this selector allows the choice of the active firing pin and prevents the simultaneous use of the two barrels. The cocking of the firing pins is carried out here by the tipping and then the closing of the barrels, with the result that we then have a weapon likely to fall and shoot accidentally under some conditions.

It is sought by the security and law enforcement forces, a single trigger weapon for two or more barrels that moreover, can be cocked and loaded without a visible dog and can be used in double action to avoid the risk of accidental departure in the event of an accidental fall.

It is also wanted to know before firing, which gun will be active when pulling the trigger, and this without having to open the weapon.

BRIEF SUMMARY OF THE INVENTION

The achievements according to the invention are particularly intended for the field of non-lethal or incapacitation weapons, and shall permit the use of a wide variety of projectiles as different as expansive inert kinetic projectiles or projectiles equipped with a pyrotechnic and/or chemical active charge.

The invention gives the advantage that it is possible to hold two different munitions simultaneously and to select by a simple mechanism which barrel will be fired with the single trigger common to the two barrels.

The present invention unveils a device or mechanism of initialization, cocking and percussion, for a weapon with two barrels juxtaposed or superimposed, whether it uses a single action or a double action to trigger the percussion of the cartridges, whether they are small, medium or large. The present realization makes it possible to ensure the percussion in each of the two barrels with a movement of each firing pin following barrel axis, each pin being accelerated by an independent inertial hammer (6*a*, 6*b*) this realization minimize the number of pieces which facilitates the manufacture.

The invention solves the problem of obtaining a safety mechanism for professional users using a small, medium or large-caliber weapon under operational conditions, which operates with a single trigger for two barrels and a cocking and percussion mechanism working in double action mode without apparent dog. The problem is also to obtain a reliable initiation sequence with axial firing pins in relation to the barrels and to know at the moment of the shot by a simple look with which barrel we should or will shoot. Shifting the active barrel should be realized in a simple way. This invention also makes it possible to improve the ammunition used and to reduce the malfunctions as observed by the police for realizations according to the invention FR 2.801.377 while keeping the main advantages of this realization concerning the safety of double action without apparent dog, and with a single trigger.

It is also possible, by virtue of the present invention, to obtain a knowledge of the active gun ready to fire and to select at the time of closing the weapon which gun will be cocked and fired first; at the same time the invention allows the display of an indicator which signal which is the active barrel after closing.

This improvement allows for example to always fire the same barrel after a reload executed by having fired a single shot, while retaining a different ammunition corresponding to a change in operational situation, or emergency mode in relation to an assault that requires a stronger response. This allows the weapon to better adapt the ammunition to the threat or situation. For example, in a riot situation, people may be held at a distance by smoke-tear ammunition, but a kinetic ammunition may be used against a pebble-throwing demonstrator.

Thus according to the invention and in order to solve the problems described above, we unveil the realization of a cocking and percussion mechanism for dual barrel launchers, which works in double action with a single trigger, without apparent dog; firing pins with a movement parallel to the barrel axis.

DETAILED DESCRIPTION OF THE INVENTION

Figure 1:
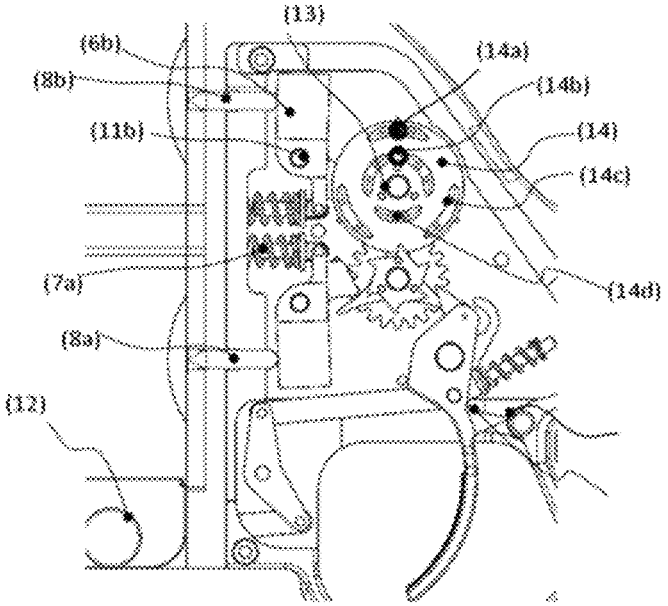
FIG. 1 illustrates the full dual action cocking and percussion mechanism in according with one embodiment of the present disclosure.

All descriptions and associated figures or drawings are given for superimposed dual-barrel weapons which are the most sold for professionals, but the invention can also be used or adapted simply according to the state of the art to juxtaposed barrels, in particular by a modification of the trigger, or by the addition of an intermediate motion transfer part capable of transforming the action on the trigger plane in a perpendicular plane motion.

The first description of the mode of action of the mechanism according to the invention is given in the rest of the text, assuming that a weapon with a superimposed barrel is used and that the lower barrel has chosen to start the firing sequence.

In FIGS. 1-6, this realization of said mechanism of cocking and percussion for a weapon with two barrels allows an alternative cocking of both hammers (6*a*, 6*b*) associated with barrels (11*a*, 11*b*) with a same finger action on a single and unique trigger lever (1); acting on said trigger (1) an integral assembly linked with each one of those barrels (11*a*, 11*b*) is led into rotation. For the lower barrel (11*a*), this integral assembly also encompasses a ratchet (2) fully bound to the lower three branched star (3*a*) and toothed wheel (4*a*) also called lower gearwheel or pinion. Said ratchet (2), which is bound or made in an integral assembly encompassing the three branched star (3*a*) is led in rotation by the mobile pushing beak (5*a*) moved by means of the trigger (1) on which the shooter comes to exert an action. In response to this movement by means of the beak (5*a*), the star (3*a*) which is also part of this integral assembly (2, 3*a*, 4*a*) comprising the lower ratchet (2), three-branched star (3*a*) and gearwheel (4*a*), rotates the lower hammer (6*a*), and compresses the associated spring (7*a*). This action produces a rotation effect of the same angle but with a reverse direction on the upper hammer (6*b*) and on the upper integral assembly (3*b*, 4*b*), which consists of the three-branched star and the upper gearwheel, but does not act on the upper hammer (6*b*). At the end of the action on the trigger, the branch in support of the star (3*a*) arrives at the limit of its action or contact and releases said inertial hammer (6*a*); which under the action of the spring (7*a*) relaxes abruptly and comes to accelerate said hammer (6*a*) in reverse rotation so that it will strike the lower firing pin (8*a*) at a maximum speed. This completes the firing cycle of the ammunition loaded into the lower barrel and positions the mechanism to now act on the upper barrel. In particular, the invention is functional because the 4*a* gear is positioned side by side with the 4*b* gear which it drives in reverse rotation having the same diameter and having the same number of teeth; the actions on the upper barrel (11*b*) are also transmitted through the lower gear (4*a*); that the cocking actions of each of the hammers (6*a*, 6*b*) are obtained alternately in rotation by the contact and the respective action of a branch of each of the three-branched star parts (3*a*, 3*b*) until their release by lack of contact.

As mentioned, during all this action of cocking and percussion of the lower barrel, the lower gear (4*a*) drives in reverse rotation the upper gear (4*b*) attached to the star (3*b*). After striking the loaded round in the lower barrel, the lower star (3*a*) is no longer in contact with the hammer it released, but now the upper star (3*b*) is now in contact with the upper inertial hammer (6*b*). The lower (6*a*) and upper (6*b*) hammers thus act sequentially in an alternative and independent manner. Each of these hammers acts respectively on firing pins for the independent initiation of each of the ammunition loaded respectively in the upper and lower barrels.

After releasing the trigger, it is therefore possible to repeat another action and thus reproduce the same movement described on the elements of the upper part until the release of the said hammer and the action of the spring (7*b*) which causes the percussion of the upper blow by the firing pin (8*b*).

In order to solve the problem of performing an alternative double action procedure for two barrels with a single trigger, the invention uses the alternative action through two three-branched star parts (3*a*, 3*b*) on their respective hammer (6*a*, 6*b*), which also makes it possible to solve the known problem of achieving a linear motion parallel to the axis of the barrels (11*a*, 11*b*) for each of the firing pins (8*a*, 8*b*) while performing a double action from a single trigger (1).

It is obvious to the man of art that such a mechanism can be transposed without difficulty for the realization of a juxtaposed dual launcher by a rotation angle of ninety degrees between the action on the trigger and the rotation of the integral assemblies consisting of a gearwheel and a three-branched star part.

It can be noted that the two barrels may not be completely parallel and be made with a small angle, typically less than 5 degrees of angle, allowing a compensation of the parallax of sight in order to obtain a common point of convergence of the projections at a given distance from the weapon when the aiming device is located above the barrels, for an overlay; or in the middle of the cannons, for a side-by-side cannon launcher.

Such a limited angle has no impact on the efficiency or reliability of the device according to the invention, while according to the state of the art this convergence increases the angle between the firing pin and the barrel axis.

In an improvement of the realization according to the invention of such a device of armament and percussion, the inventors prefer to add an external indicator, arranged so that it can be seen or touched from the outside by the user and which can be achieved, in particular by associating, according to the position of the rotating assembly (gearwheel, three-branched star, ratchet) a moving mark that protrudes from the frame of the weapon. This possibility of seeing or touching the position of the index finger up or down, in the case of a superimposed weapon, solves the problem of knowing the activity of the barrel during the next action on the trigger, even when the weapon is closed and ready to fire.

For example, this moving marker can take the form of a circular index with groove(s) or boss(s) on a gearwheel (4*a*) For example, this makes it possible to change the position of an indicator external to the case of the weapon which can be realized in different ways. For example, it can be made in the form of metal or plastic part that appear or disappear when one of the barrels is active. It can also be an electronic indicator that uses an external power source, or an energy harvesting system.

The main advantage of such an electronic device may be to be able to be connected to sensors or readers that can materialize or display in signs, numbers, letters or even voice announcement, which ammunition is loaded into the barrel and will be initiated by pressing the trigger. Thus, in the case of ammunition with an indicator, such a device also makes it possible to identify it in the same way.

In a favorite realization of the inventors, which solves the problem of changing the barrel that will be active in the first place when the barrels are open and that can be operated or not during the reloading action. The disclosed mechanism (9) remains independent of the weapon's cocking and percussion mechanism and becomes active only when the weapon is opened and in a state where it is impossible to obtain a percussion or initiation by acting on the said percussion mechanism. The said mechanism consists of three parts (9*a*, 9*b*, 9*c*) first a rod (9*a*), a cam or inversion lever (9*b*), and a lever or push rod (9*c*).

In the realization of such an additional device of the invention, the inventors prefer by example to initiate the firing cycle by activating the upper cannon for the superimposed launchers. Thus, according to this method of carrying out the said barrel change device, when the barrels are opened or completely broken, the rod (9*a*) will be moved in a sufficiently long path to operate the finger (5*b*) of the trigger (1) in rotation against the lower three-branched star part (3*a*) to the point where the branch in contact is no longer engaged with the lower hammer and free the corresponding hammer (6*a*).

This release of the hammer causes an effective initiation of the lower firing pin (8*a*), which, because of the open position of the weapon, does not meet the initiation of a round. The achievement of this cycle causes an automatic reset by activating the upper gun for the next action on the trigger (1), when the barrels are loaded and closed.

If the upper barrel has just been fired before the opening of the weapon, the full opening of the weapon will activate the percussion when the lower barrel percussion weapon is opened but no ammunition is fired out of the field due to the open position; when the weapon is then closed the upper barrel is then ready to be fired again. In the other case, if the barrel that has just been fired before the opening has been fired with the lower barrel, the three-branched star part (3*b*) is already in grip and the opening then pushes the rod (9*c*) which induces in rotation the finger (5*b*) but without any action on the lower three-branched star (3*a*).

The dimensions of the levers and the angles formed by the said levers or rods (9*a*, 9*b*, 9*c*) between them may be dimensioned in order to obtain an action by the rotation of the finger (5*b*) on a branch of the three-branched star (3*a*), thus effecting an inversion when a complete opening of the weapon is made in the breaking open position. An inversion mechanism realized in this way, thus allows users to use only the upper barrel in current use and to reserve the lower barrel for use with a different ammunition.

In order to solve the problem of securing the percussion against the two barrels with a single safety device, the inventors preferred to block the trigger in a way known according to the state of the art, but characterized in that part of the trigger is blocked in its movement by the safety rod in the resting position. On the contrary, when the safety device or safety button is in the fire position, the trigger can make a complete movement by moving through a groove or groove of the device without being prevented in its path to ensure a berthing and then an action on the ratchet (2).

In another embodiment according to the invention that permits the firing of at least one barrel in single-action mode, the apparatus according to the invention is characterized in that a lever or rod can be directly manipulated from the outside of the housing by the user because it is attached to one of the hammers in order to be able to carry out the cocking of said hammer without pressing the trigger. Thus the displacement in order to position the three-branched star part (3*a* or 3*b*) corresponding to this barrel in a position very close to the release of the hammer, and held in this position by a push finger or any other device allowing its release by a minimal action on the trigger, without modifying the other features of the invention.

Figure 5A:
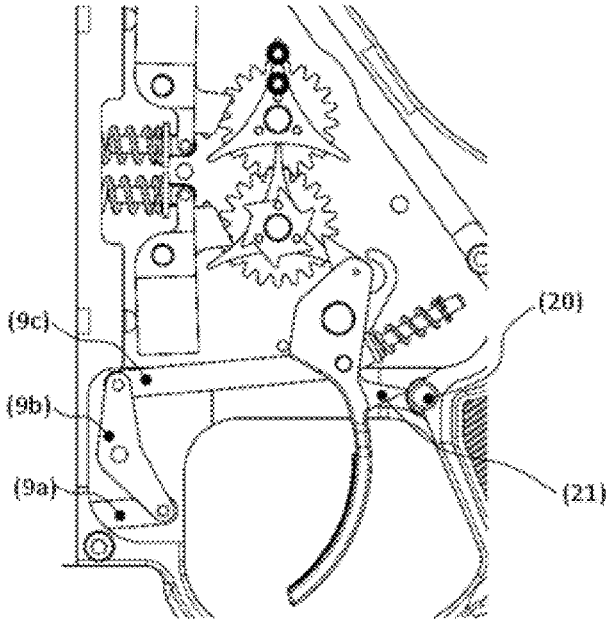
FIGS. 5*a* and 5*b* illustrate the cocking and percussion mechanism when a weapon is close in according with another embodiment of the present disclosure.
Figure 5B:
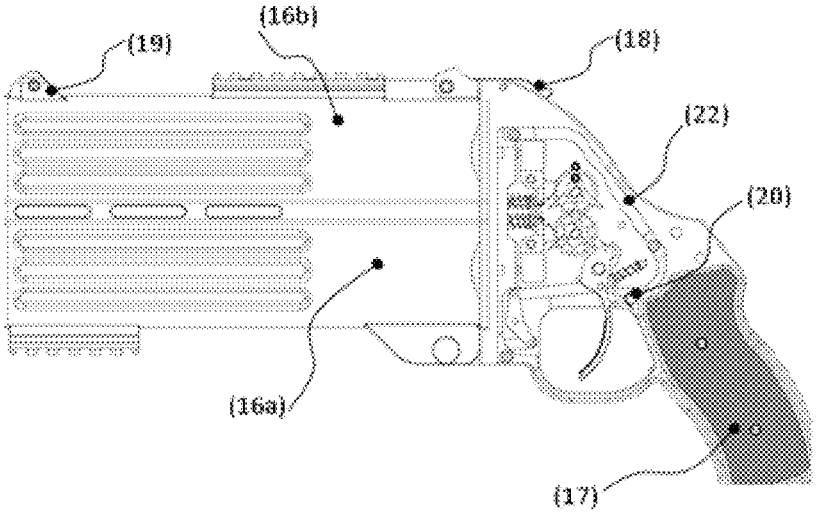
Figure 6A:
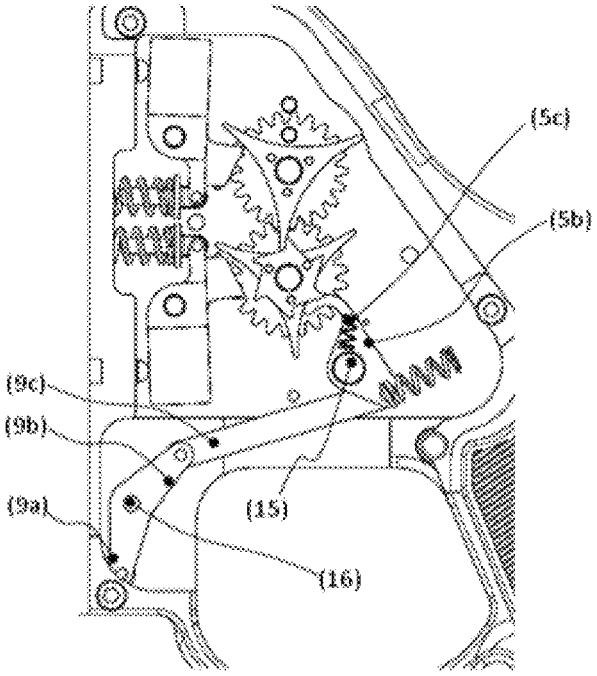
FIGS. 6*a* and 6*b* illustrate the cocking and percussion mechanism when a weapon is open in according with another embodiment of the present disclosure.
Figure 6B:
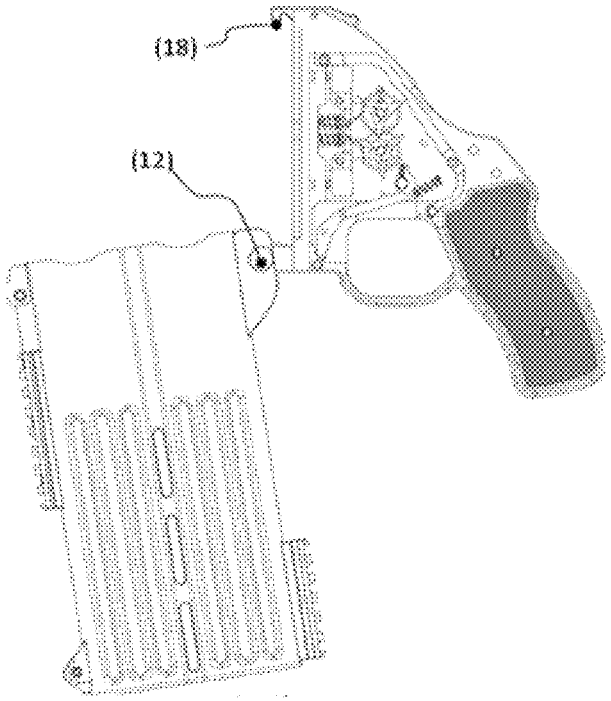

In a favorite embodiment of the invention, in FIGS. 5*a* and 5*b*, it is revealed that if the length of the segments (a and b) of the motion inverter (9) and the length of the push rod (9*c*) are properly adjusted, a different action on the percussion can be achieved when the weapon is opened, as shown in FIGS. 6*a* and 6*b*. Indeed, the purpose of the levers (9*a*, 9*b*, 9*c*) is during the maximum forced opening in stop, to act on the ratchet and thus on the percussion in order to provoke a percussion movement without initiation, which thus modifies the next active barrel.

The levers (9*a*, 9*b*, 9*c*) shall be dimensioned so that when the weapon is opened by forcing the barrel block (16*a*, 16*b*) as a stop the active barrel is modified when closed and when the barrel block (16*a*, 16*b*) is opened without forcing it as a stop. The reduced opening angle does not change the active firing pin during closing. Such a device thus giving the choice, when reloading the weapon for the barrel which will be used first after closing the weapon. It is of course possible to use this mechanism to change the active barrel by opening the barrel block to the stop even without the need for reloading. When the gun is opened, the percussion is of course inactive on the ammunition that could be held in either barrel (16*a* or 16*b*).

The following advantages of the invention can be highlighted:

- possibility of reciprocal firing of two barrels with percussion parallel to the cannons by means of a double-action mechanism with a single trigger;
- option to reset or change the first active firing pin after closing when the weapon is opened to change a round;
- possibility of immediately knowing the active barrel if the trigger is pressed, without opening the weapon;
- it is possible to carry out a weapon with the possibility of single-action firing by means of a lever which protrudes from the case or plate of the launcher, and it will then be possible to arm and fire at least one single or double-action barrel, cocking the lever to use the weapon as a single action can be performed, for example, by a larger action or stroke of the opening movement for reloading. In this case, the single-action arm lever may be associated with or integrated with the reset mechanism (9), which can then be associated, for example, with a single barrel that would be capable of a weapon closing procedure allowing a single-action shot, and therefore more accurate.

For the proper operation of the device it is necessary that each of the two integral assemblies (2, 3*a*, 4*a*) and (3*b*, 4*b*) have a gearwheel of the same diameter and each of which has the same number of teeth of the same geometry and are arranged side by side, so that if one is rotated clockwise, the other is operated in reverse order.

In order to transform the linear action on the trigger into the rotation action of one of the two assemblies already described, it was designed a mobile beak (5*a*) linked to the trigger (1) by a rotation axis around which it is freely rotating with limitation in angle.

When resting, the beak (5*a*) is held in rotation stop by its return spring (5*c*) which allows it to operate when an action is applied to the trigger (1) from the resting position onto the ratchet (2) in the clockwise direction; said ratchet being itself bounded to the lower three-branched star part (3*a*) which rotates the hammer (6*a*) until it is released at the end of the detent stroke and also onto the toothed road (4*a*) which drives the gearwheel (4*b*), in the opposite direction, said upper gearwheel itself attached to a three-branched star (3*b*) that actuates the hammer (6*b*) and, secondly, after the release of said hammer (6*b*) it is brought down by the ratchet during the return of the trigger under the action of the return spring (10*b*) sliding on the ratchet without being able to drag it counter-clockwise. Before the trigger reaches its resting position, the said moving beak (5*a*) is released and returns to the action position under the action of its return spring (5*c*).

According to one of the inventors' favorite realizations, three-branched parts (3*a, b*) are rotated by their coupling with the ratchet (2) and by the movement of gearwheel (3*a*) bounded to said ratchet, the three-branched star parts (3*a, b*) have an alternative action each on their associated hammer (6*a, b*) so that when a firing is initiated by the release of the hammer associated for example to the lower barrel (6*a*) by the star part (3*a*), said hammer escapes almost simultaneously at the time of the percussion and is no longer subsequently in contact with a three-branched star or a star's branch (3*a, b*) before the end of the next cycle of armament and percussion which is caused by the integral assembly (3*b*, 4*b*) including the three-branched star part (3*b*) which is now in contact with its associated hammer (6*b*).

According to an improvement of the invention, the mechanism has a lever or rod which allows the user to operate directly from the outside of the case of the weapon the cocking device of at least one of the two hammers, after this action the mechanism can then be released by an action on the trigger (1) according to a direct action or even in simple action.

Said lever allowing to obtain an armed position of the hammer similar to that obtained directly by the action on the trigger through the mechanism of by the action of the three-branched star part (3*a* or 3*b*) and corresponding to a static position which would be obtained just before the said parts release the said hammer, this static position being obtained by a lock-type part, gate or hook that could then be released by an action weaker than usual on the same trigger (1). This single-action armed position may be achieved by a groove or hole in one of the parts as described or in the frame of the weapon, and possibly by means of a moving part to which it is linked and a return spring, on which the user can come and act directly from the outside.

According to a realization variant according to the invention, the activated barrel may be configured to fire first, when the weapon is opened by a mechanical device which is only functional when the weapon is opened and closed, and allows the user to change the active barrel during reloading depending on the barrel that just fired. You may also choose not to reset the shot when opening the weapon.

For example, if the user just shoots with the lower barrel, he opens the weapon; If it fully opens the mechanism is thus reset and it is still ready to fire on the lower barrel. If he opens it at two-thirds where he feels a first resistance, he does not reset the mechanism and when he closes the barrel block, he will be ready to fire on the upper barrel.

According to a preferred version of the inventors, the device of choice or change of the active barrel consists of a rod or lever of thrust (9*a*) attached to the barrel block (11), a lever or cam of inversion 9*b*) and a lever or pull (9*c*), said parts (9) being all interdependent by links to at least one degree of freedom in order to obtain a simultaneous action on the trigger (1) and on the finger (5*b*) and thus cause during the opening and closing of the weapon; and at the choice of the user, either a reset to a predefined barrel, or a change of the active barrel first when closing the weapon.

Depending on an improvement of the invention, it is possible to easily produce a fire indicator that provides a visual and/or tactile aid so that the user can have knowledge of the active barrel without opening the weapon. Such an indicator may be produced with an index in the form of at least one perforated washer with recessed or humped areas and associated with at least one of the gearwheels.

The disclosed invention is now described in detail according to its representation in the documents annexed to it.

FIG. 1 shows the full dual action cocking and percussion mechanism, with a single trigger, equipped with a firing pin almost parallel to the axis of the barrels and allowing a change of the barrel activated by pressing the trigger after closing the weapon. This figure shows a single trigger (1) allowing the two barrels to be activated alternately by means of the aforementioned mechanism according to the invention, which supports and rotates the ratchet (2) attached to a lower three-branched star (3*a*), and the lower gearwheel (4*a*).

This action of the trigger on the ratchet (2) by means of the movable beak (5*a*), which is itself supported by a stop by a limit switch (5*b*), leads said ratchet (2) in the clockwise direction, it is also attached to the lower three-branched star part (3*a*) and the lower gear (4*a*).

Its rotation under the thrust of the beak (5) drives the ratchet (2) in the same rotation direction and it drives the lower hammer (6*a*) in rotation around its axis in the counter-clockwise direction, thus compressing the spring of the lower firing pin (7*a*). When one three-branched star part (3) escapes the hammer (6), we have on the one hand a release of the hammer spring (7*a*) under tension which accelerates the firing pin (8) and causes the initiation of the shot by crushing and impact effect on the primary pyrotechnic primer of the ammunition; on the other hand, at the same time, the rotation of the bottom integral assembly consisting of the ratchet (2), the three-branched star part (3*a*) and the gear (4*a*) causes the upper integral assembly consisting of the gear(4*b*) to rotate in the opposite direction with the three-branched star part (3*b*), After the initiation in the lower barrel, the lower three-branched star part (3*a*) is no longer in contact with the hammer (6*a*), but when the trigger is released (1), it is brought back to the initial resting position by the action of the spring (10*b*), mounted on the rigid rod (10*a*) which serves as a guide, during this return of the trigger assembly equipped with its appendages (5*a*, 5*b*) and the associated spring, the beak (5*a*) will then be forced against the ratchet (2) in the clockwise direction, during this contact said beak (5*a*) will come to compress its spring and thus rub on the ratchet escaping the notch in which it was positioned during the action of armament and percussion without having on said ratchet any movement action. At the end of the stroke, the beak (5*a*) exceeds the next notch of the ratchet (2) and is ready again for the next action.

At the same time, the three-branched star part (3*b*) is now in contact with the upper hammer (6*b*). If a new pushing action is then carried out on the trigger (1), the integral assembly of the ratchet is then rotated (2), which moves the gearwheel (3*a*) clockwise, which in turn operates the gearwheel counter-clockwise (3*b*), attached to the upper star (3*b*), which is in contact with the upper hammer (6*b*) rotating around its axis, thus putting its spring in compression (7*b*). At the end of this action on the trigger, said spring is at its maximum compression which corresponds to the trigger weight, then the active branch of the star (3*b*) releases the hammer; (6) which under the action of its spring (7*b*) compressed accelerates the hammer (6*b*) in rotation around its axis, during this movement said hammer will come to hit the firing pin (8*b*) while it has reached its maximum speed. Because of its weight and constitution, the firing pin (8*b*) then acquires a speed by preserving the amount of movement obtained during the perfectly inelastic impact with the hammer. The energy of this firing pin allows it to initiate by shock the initiation of the ammunition chamber which is usually made up of a primary explosive sensitive to the shock and thus to realize the departure of the shot charged in the launching tube or barrel (11*b*). This event puts an end to the complete cycle realized in order to initiate successively two munitions loaded respectively in the two tubes or barrels.

Figure 2:
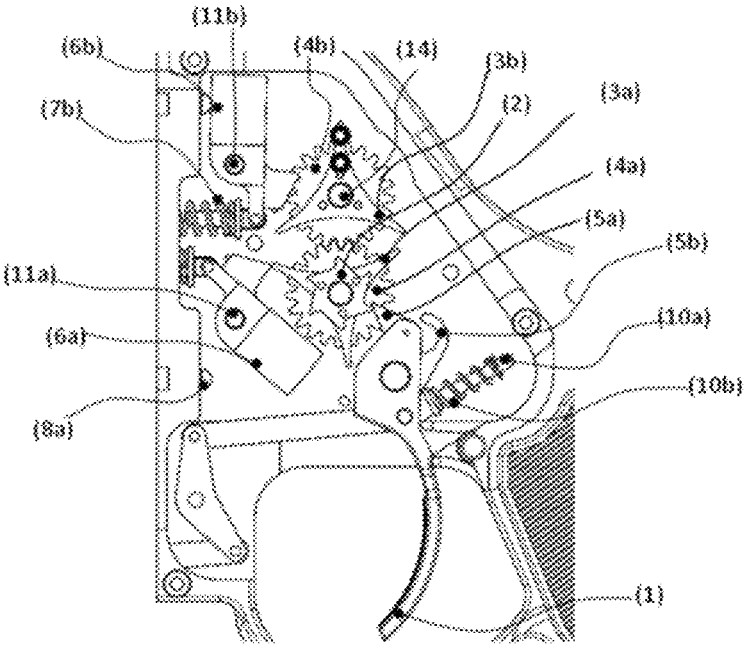
FIG. 2 illustrate the cocking and percussion mechanism to be switched from one tube to another and also to perform an automatic reset of the upper barrel after an opening or reloading of the weapon in according with another embodiment of the present disclosure.

FIG. 2 describes the additional mechanism to the invention, which allows the cocking and percussion mechanism to be switched from one tube to another and also to perform an automatic reset of the upper barrel after an opening or reloading of the weapon. When the weapon is opened by breaking the barrels (11*a*, 11*b*), the rod (9*a*), fixed on the barrel block (11), is pushed and exerts a pull on the rod (9*c*), via the inverter (9*b*), comes to push the finger (5*b*) in rotation. If the last shot was made on the upper barrel, then the finger exerts pressure on the three-branched star part (3*a*) clockwise; if the weapon is opened completely, the integral assembly (2, 3, 4) is moved by the equivalent of a ratchet, which incidentally triggers the movement of a firing pin.

This trigger occurs when the weapon is opened, it remains safe for the user. Thus, when the weapon is then closed, we find ourselves in the armament situation of the previous blow and it is therefore always the upper barrel that will be active.

Account must be taken of an additional possibility of dimensional execution of the said mechanism and in particular of the rods and levers (9*a*, 9*b*, 9*c*) which allows if the weapon is opened incompletely but nevertheless sufficient to ensure the reloading of the ammunition, not to alter the order of activation of the cannons, the finger (5*b*), then exerts insufficient movement for the three-pointed cross to release the firing pin, thus, when closing, it is the lower barrel that will be active. Therefore, it is possible in operation for the user, to change the barrel if necessary, only by making a complete opening of the weapon without touching the ammunition. This provides a real operational advantage.

Figure 3:
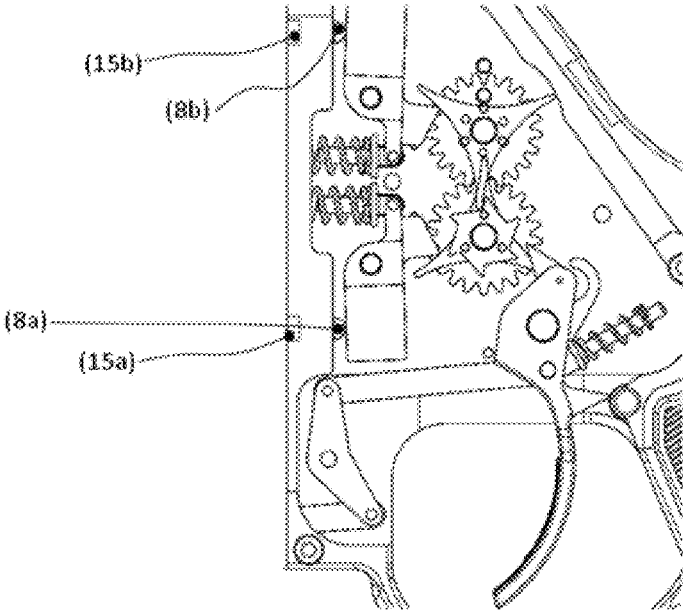
FIG. 3 illustrates an enlarge view of the cocking and percussion mechanism of FIG. 1 in according with one embodiment of the present disclosure.
Figure 4:
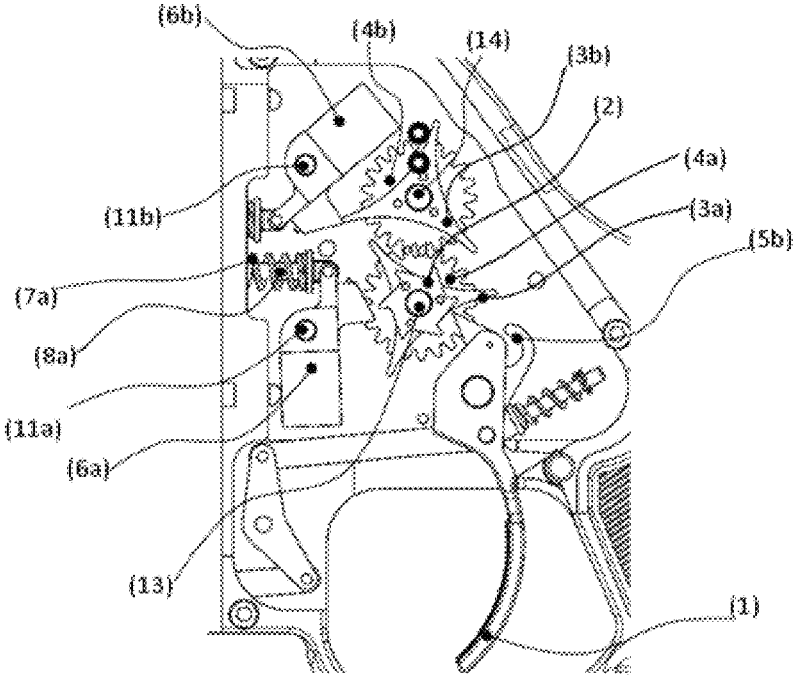
FIG. 4 illustrate the cocking and percussion mechanism to perform the automatic reset of the lower barrel in according with another embodiment of the present disclosure.

FIG. 3 is an enlargement of detail on the armament and percussion mechanism, no functional difference is to be noted in relation to FIG. 1, it is simply easier to see how the trigger (1) interacts and acts on the ratchet (2) and the action of the movable beak (5*a*) which is connected to the trigger (1) by its axis of rotation.

The invention claimed is:

1. An initialization, cocking and percussion device for a caliber firearm with a first barrel and a second barrel which are juxtaposed or superimposed, wherein the first and second barrels respectively have a first firing pin and a second firing pin moving along axes of the first barrel and the second barrel, the first and second firing pins are respectively accelerated by first and second independent inertial hammers; the device comprises one single trigger; an interaction between the trigger and the first or second hammer associated with the first or second barrel is carried out for each of the trigger and the first or second hammer by means of a first or second integral assembly dedicated to each of the trigger and the first or second hammer, each of said first and second integral assemblies consisting of a gearwheel, a three-branched star part, the first integral assemblies includes a ratchet dedicated to the first barrel, said ratchet is bound with the three-branched star part and the gearwheel of the first integral assembly, said ratchet is moved in rotation directly by a break, said break is linked with the trigger in order to put said first assembly in rotation on a predetermined direction, wherein the gearwheel of the first integral assembly is positioned side by side with the gearwheel of the second integral assembly that it drives in the opposite direction, being of the same diameter and equipped with the same number of teeth;

wherein actions on the second barrel are also transmitted though the gearwheel of the first integral assembly;

wherein cocking actions of the first and second hammers which are obtained alternately in rotation by the respective contact and action of one branch of each of the three-branched star part of the first or second integral assembly until the three-branched star part and the first or second hammer are released by lack of contact.

2. The device according to claim 1, wherein the trigger is equipped with the beak associated with a return spring in order firstly to actuate the ratchet in a clockwise direction; said ratchet is bound with the lower three-branched star part of the first integral assembly which rotates the first hammer until its release at an end of a travel of the trigger and the gearwheel of the first integral assembly which drives counter-clockwise the gearwheel of the second integral assembly, bound with the upper three-branched part of the second integral assembly which is able to actuate the second hammer and secondly, during a return path of the trigger under an action of a spring, to be brought in a low position by rubbing and sliding of the ratchet, without being able to drive the ratchet until the trigger arrives in a resting position where the trigger escapes from a contact with said ratchet and is settled back in an action position under the action of the return spring.

3. The device according to claim 1, wherein the three-branched star parts of the first and second integral assemblies, rotated due to the three-branched star parts correspondingly coupling with the gearwheels of the first and second assemblies or with the ratchet, have each an alternative action on the corresponding first or second hammer so that when an ammunition initiation is achieved by one of the first and second hammers, the first hammer under the release of the three-branched start part of the first integral assembly, said first hammer is no longer in contact with a branch of said three-branched star part of the first integral assembly before the end of the following cocking and percussion cycle.

4. The device according to claim 1, wherein at least a lever is directly actuated by the user directly from outside the weapon frame in order to make cock at least one of the first and second hammers up to a state where the corresponding three-branched star part of the first or second integral assembly is near to release, and clutched to this position by a clutching part which is overcome by a simple short pulling action on the trigger, wherein the lever possibly obtains a cocked position similar to the one obtained directly by a trigger action though the first or second assembly encompassing the three-branched star part and corresponding to a static position which will be obtained just before said three-branched star part release the corresponding first or second hammer, the static position is obtained by a lock-type part, gate or hook that then is released by a weak action on the trigger.

5. The device according to claim 4, wherein the cocked position is achieved by a groove or hole in one of the three-branched star parts of the first and second integral assemblies or in a frame of the firearm, and possibly with the help of a moving part and a return spring.

6. The device according to claim 1, further comprising an independent mechanism comprising a rod bounded with a barrel block, one reversing cam and a lever pull activated when opening or reloading the first and second barrels or reloading action, wherein the independent mechanism is made with the rod, the reversing cam and the pull in order to obtain simultaneous action on the trigger and on a finger and thus provoke when opening and closing the weapon either reset to the same barrel or shift to the other one.

7. The device according to claim 1, wherein an external indicator is implemented to allows the first or second barrel, which is active, to be seen by the user without opening the firearm, the external indicator is made by a mechanism comprising at least one index linked with at least one gearwheel.

8. The device according to claim 1, further comprising a mechanism for selecting or changing the first or second barrel which is active consists of a rod attached to a barrel block, a reverse cam, and a lever, the rod, reverse cam and the lever are all interdependent by links to at least one degree of freedom in order to obtain a simultaneous action on the trigger and on the finger and thus cause during the opening and closing of the firearm; and at the choice of the user, either the barrel which is predefined is reset or the barrel which is active is changed first when closing the firearm.

* * * * *